US010722912B2

(12) United States Patent
Singh

(10) Patent No.: US 10,722,912 B2
(45) Date of Patent: Jul. 28, 2020

(54) LOCK ASSEMBLY FOR GRIT BOOT MASK TOOL

(71) Applicant: United Technologies Corporation, Farmington, CT (US)

(72) Inventor: Vikramjit Singh, Middletown, NY (US)

(73) Assignee: Raytheon Technologies Corporation, Farmington, CT (US)

( * ) Notice: Subject to any disclaimer, the term of this patent is extended or adjusted under 35 U.S.C. 154(b) by 188 days.

(21) Appl. No.: 15/871,305

(22) Filed: Jan. 15, 2018

(65) Prior Publication Data

US 2019/0217321 A1 Jul. 18, 2019

(51) Int. Cl.

| | |
|---|---|
| ***B05B 12/20*** | (2018.01) |
| ***E05C 3/12*** | (2006.01) |
| ***F01D 5/00*** | (2006.01) |
| ***B24C 3/32*** | (2006.01) |
| ***B24C 1/04*** | (2006.01) |

(52) U.S. Cl.

CPC ..... *B05B 12/20* (2018.02); *B24C 1/04* (2013.01); *B24C 3/32* (2013.01); *E05C 3/12* (2013.01); *F01D 5/005* (2013.01); *F05D 2220/30* (2013.01); *F05D 2230/10* (2013.01); *F05D 2240/24* (2013.01)

(58) Field of Classification Search

CPC .. B05B 12/20; B24C 1/04; B24C 3/32; B05C 3/12; F05D 5/005; F05D 2220/30; F05D 2230/10; F05D 2240/24

See application file for complete search history.

(56) References Cited

U.S. PATENT DOCUMENTS

| | | | | |
|---|---|---|---|---|
| 3,862,773 A | | 1/1975 | Bisbing | |
| 4,695,486 A | * | 9/1987 | Stark | B05D 1/32 427/282 |
| 4,704,987 A | * | 11/1987 | Curtze | B05B 12/20 118/500 |
| 5,645,466 A | | 7/1997 | Wikle | |
| 5,792,267 A | | 8/1998 | Marszal et al. | |
| 5,849,359 A | | 12/1998 | Burns et al. | |
| 5,998,755 A | | 12/1999 | Zajchowski et al. | |
| 6,037,004 A | | 3/2000 | Zajchowski et al. | |
| 6,135,050 A | * | 10/2000 | Inaba | B05B 12/20 118/301 |
| 6,299,687 B1 | * | 10/2001 | Inaba | B05B 12/20 118/301 |

(Continued)

FOREIGN PATENT DOCUMENTS

| | | |
|---|---|---|
| CN | 106346369 A | 1/2017 |
| CN | 107138325 A | 9/2017 |

(Continued)

OTHER PUBLICATIONS

European Search Report dated Jun. 3, 2019 for corresponding European Patent Application 19151946.1.

*Primary Examiner* — Dung Van Nguyen

(74) *Attorney, Agent, or Firm* — Bachman & LaPointe, P.C.

(57) ABSTRACT

A grit boot mask tool including an enclosure to receive at least a portion of a blade and a door. A lock assembly that retains the door to the enclosure. The lock assembly provides for rotating a latch to retain the door to the enclosure.

15 Claims, 5 Drawing Sheets

(56) References Cited

U.S. PATENT DOCUMENTS

| | | | | |
|---|---|---|---|---|
| 6,387,183 | B1 * | 5/2002 | Inaba | B05B 12/20 118/301 |
| 6,468,349 | B1 * | 10/2002 | Inaba | B05B 12/20 118/504 |
| 2004/0043231 | A1 | 3/2004 | Tanner | |
| 2009/0165519 | A1 | 7/2009 | Berndt et al. | |
| 2013/0167337 | A1 | 7/2013 | Dupouy et al. | |

FOREIGN PATENT DOCUMENTS

| | | | |
|---|---|---|---|
| EP | 1884312 | A1 | 2/2008 |
| EP | 2145734 | A1 | 1/2010 |
| FR | 2879117 | A1 | 6/2006 |

* cited by examiner

LOCK ASSEMBLY FOR GRIT BOOT MASK TOOL

BACKGROUND

The present disclosure relates generally to a grit boot mask tool and, more particularly, to a lock assembly for a grit boot mask tool.

Gas turbine engines, such as those that power modern commercial and military aircraft, generally include a compressor section to pressurize an airflow, a combustor section to burn hydrocarbon fuel in the presence of the pressurized air, and a turbine section to extract energy from the resultant combustion gases. The compressor and turbine section include one or more arrays of blades extending radially outwardly from a rotor hub. Each blade has a root that mates with the hub to retain the blade. Each blade also has a platform that partly defines the radially inner boundary of an engine flowpath, and an airfoil that extends radially across the flowpath. During engine operation, a working gas, which flows axially through the flowpath, to receive energy from the compressor blade arrays and provide energy to the turbine blade arrays.

Those portions of the blades in direct contact with the working gas are subjected to a punishing operational environment. This is particularly true of the turbine blades, which are exposed to the elevated temperature and the effects of combustion products discharged from the engine combustion chamber. It is common practice to apply various protective coatings to the flowpath exposed surfaces of the blades to extend their useful life. Application of such coatings may often be proceeded by a grit blasting operation.

Various protective grit boot mask tools have been devised to protect selected portions of the blade during grit blasting. Conventional tools use an enclosure with a door to receive the root of the blade. A wedge piece on the enclosure is friction fit with the door to retain the door during the grit blasting operation. Although effective, the wedge may wear over time which may result in the blade falling out of the boot during the grit blasting operation. This typically requires scrapping the blade.

SUMMARY

A grit boot mask tool according to one disclosed non-limiting embodiment of the present disclosure includes an enclosure to receive at least a portion of a blade; a door; and a lock assembly that retains the door to the enclosure.

A further aspect of the present disclosure includes that the enclosure is internally shaped to receive a root of the blade.

A further aspect of the present disclosure includes that the enclosure is internally shaped to receive a root of the blade and at least a portion of a platform.

A further aspect of the present disclosure includes that the door is hinged with respect to the enclosure.

A further aspect of the present disclosure includes that the lock assembly comprises a spring biased latch.

A further aspect of the present disclosure includes that the lock assembly comprises a latch that is retained in a locked position by a spring bias.

A further aspect of the present disclosure includes a knob to push the latch away from the enclosure to overcome the spring bias and rotate the latch.

A further aspect of the present disclosure includes that a quarter turn of the knob will lock and unlock the lock assembly.

A further aspect of the present disclosure includes that the latch is received through a slot in the door.

A method of installing a grit boot mask tool to a blade according to one disclosed non-limiting embodiment of the present disclosure includes locating a portion of the blade in an enclosure; closing a door of the enclosure encasing the portion of the blade; and rotating a latch to retain the door to the enclosure.

A further aspect of the present disclosure includes that locating the portion of the blade in the enclosure comprises fitting a portion of a platform of the blade in the enclosure.

A further aspect of the present disclosure includes that locating the portion of the blade in the enclosure comprises fitting a root of the blade in the enclosure.

A further aspect of the present disclosure includes overcoming a bias on a lock assembly prior to rotating the latch.

A further aspect of the present disclosure includes pressing a knob to overcome the bias prior to rotating.

A further aspect of the present disclosure includes that rotating the latch comprises rotating a knob of a lock assembly one quarter turn.

A further aspect of the present disclosure includes that rotating the latch comprises rotating the latch transverse a slot in the door to lock the door.

A further aspect of the present disclosure includes that rotating the latch comprises aligning the latch with a slot in the door to unlock the door.

The foregoing features and elements may be combined in various combinations without exclusivity, unless expressly indicated otherwise. These features and elements as well as the operation thereof will become more apparent in light of the following description and the accompanying drawings. It should be appreciated; however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
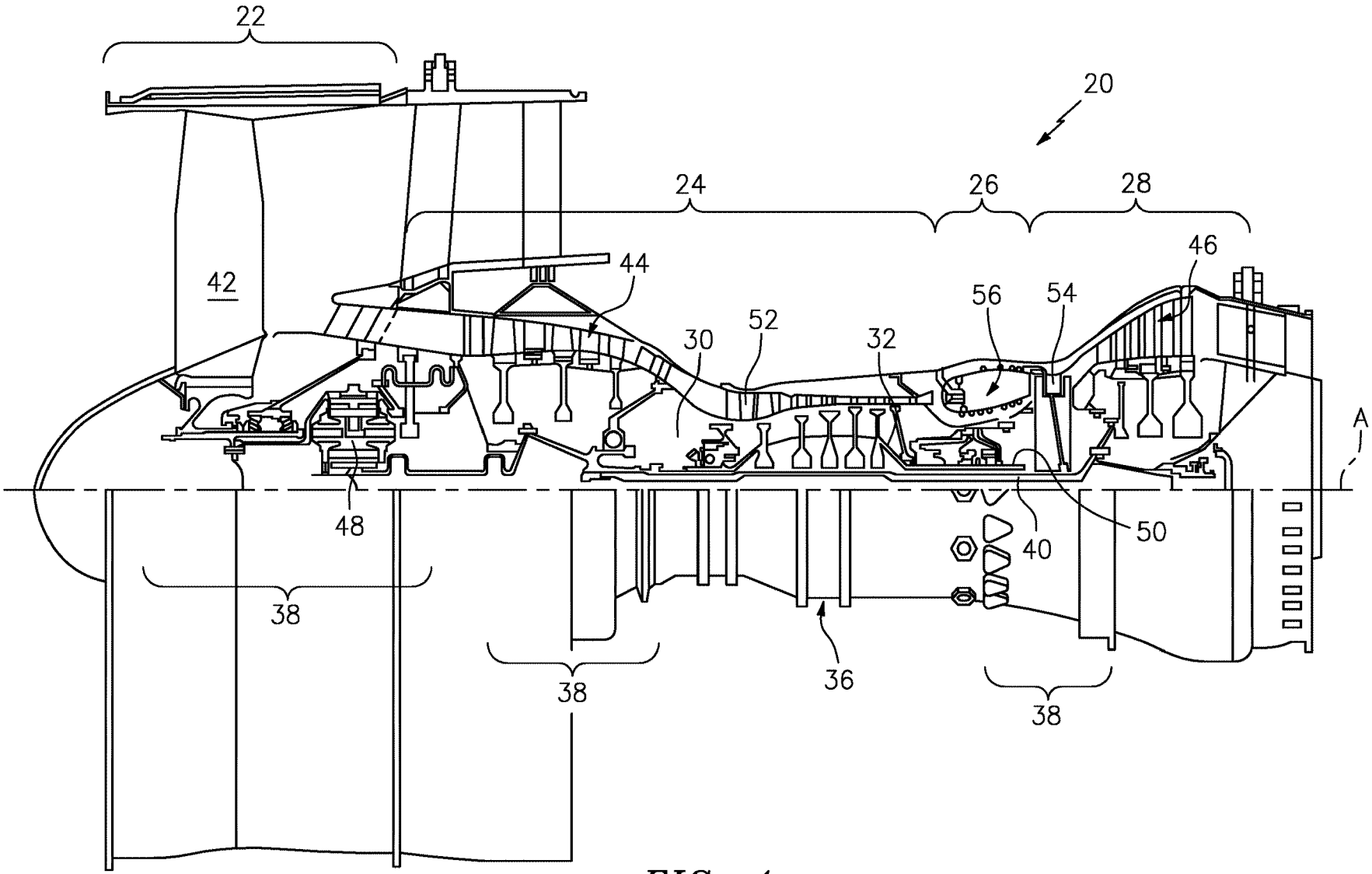
FIG. 1 is a partial cross-sectional illustration of a gas turbine engine.

FIG. 1 schematically illustrates a gas turbine engine 20. The gas turbine engine 20 as disclosed herein is a two spool turbofan that generally incorporates a fan section 22, a compressor section 24, a combustor section 26, and a turbine section 28. The fan section 22 drives air along a bypass flowpath while the compressor section 24 drives air along a core flowpath for compression and communication into the combustor section 26, then expansion through the turbine section 28. Although depicted as a high bypass gas turbofan engine architecture in the disclosed non-limiting embodiment, it should be appreciated that the concepts described herein are not limited only thereto.

The engine 20 generally includes a low spool 30 and a high spool 32 mounted for rotation around an engine central longitudinal axis A relative to an engine case structure 36 via several bearings 38. The low spool 30 generally includes an inner shaft 40 that interconnects a fan 42, a low pressure compressor ("LPC") 44 and a low pressure turbine ("LPT") 46. The inner shaft 40 drives the fan 42 directly or through a geared architecture 48 to drive the fan 42 at a lower speed than the low spool 30. An exemplary reduction transmission is an epicyclic transmission, namely a planetary or star gear system. The high spool 32 includes an outer shaft 50 that interconnects a high pressure compressor ("HPC") 52 and high pressure turbine ("HPT") 54. A combustor 56 is arranged between the HPC 52 and the HPT 54.

Figure 2:
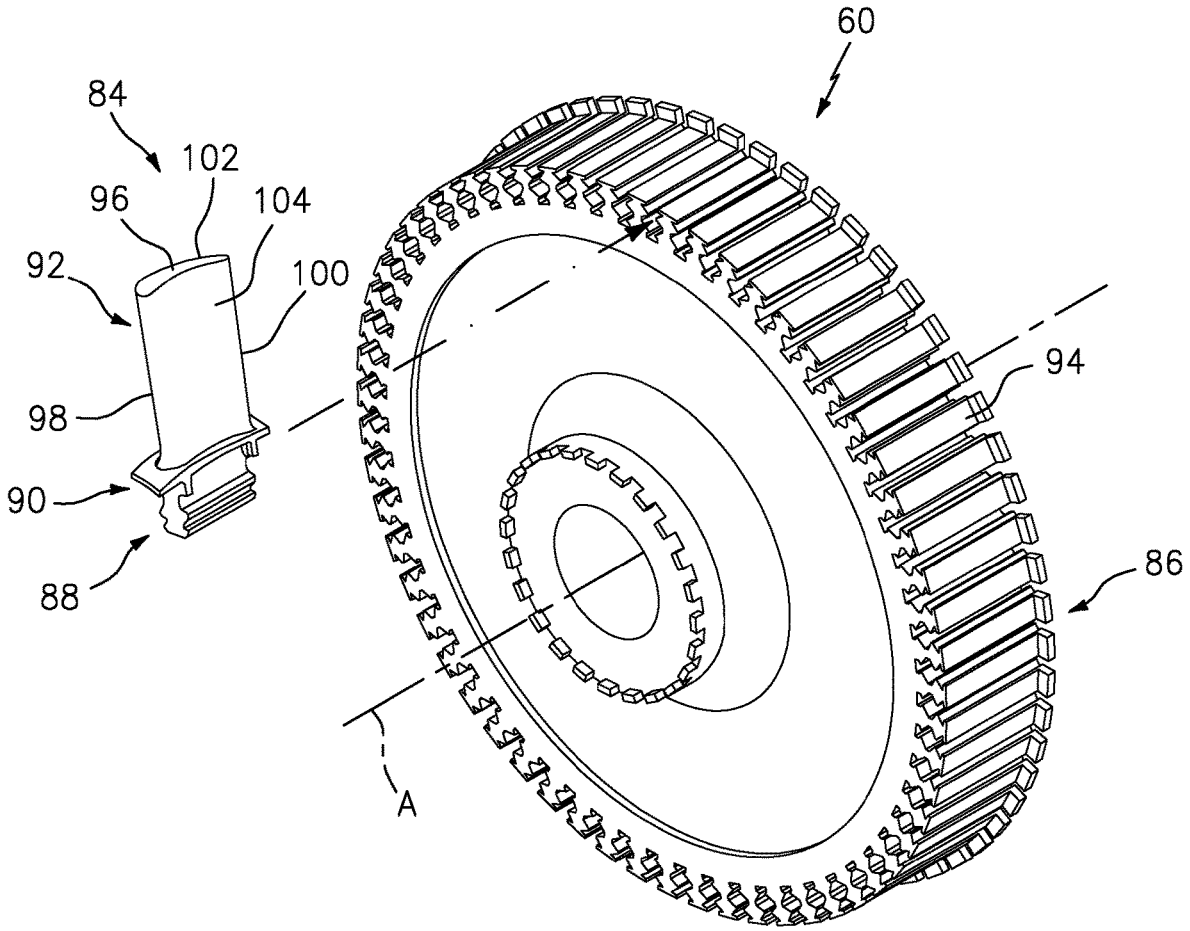
FIG. 2 is a partial cross-sectional illustration of a rotor hub of the gas turbine engine.

With reference to FIG. 2, a rotor assembly 60 such as turbine rotor assembly includes an array of blades 84 circumferentially disposed around a disk 86. Each blade 84 includes a root 88, a platform 90 and an airfoil 92. The blade roots 88 are received within a rim 94 of the disk 86 and the airfoils 92 extend radially outward.

The platform 90 separates a gas path side inclusive of the airfoil 92 and a non-gas path side inclusive of the root 88. The airfoil 92 defines a blade chord between a leading edge 98, which may include various forward and/or aft sweep configurations, and a trailing edge 100. A first sidewall 102 that may be convex to define a suction side, and a second sidewall 104 that may be concave to define a pressure side are joined at the leading edge 98 and at the axially spaced trailing edge 100. The tip 96 extends between the sidewalls 102, 104 opposite the platform 90.

Figure 3:
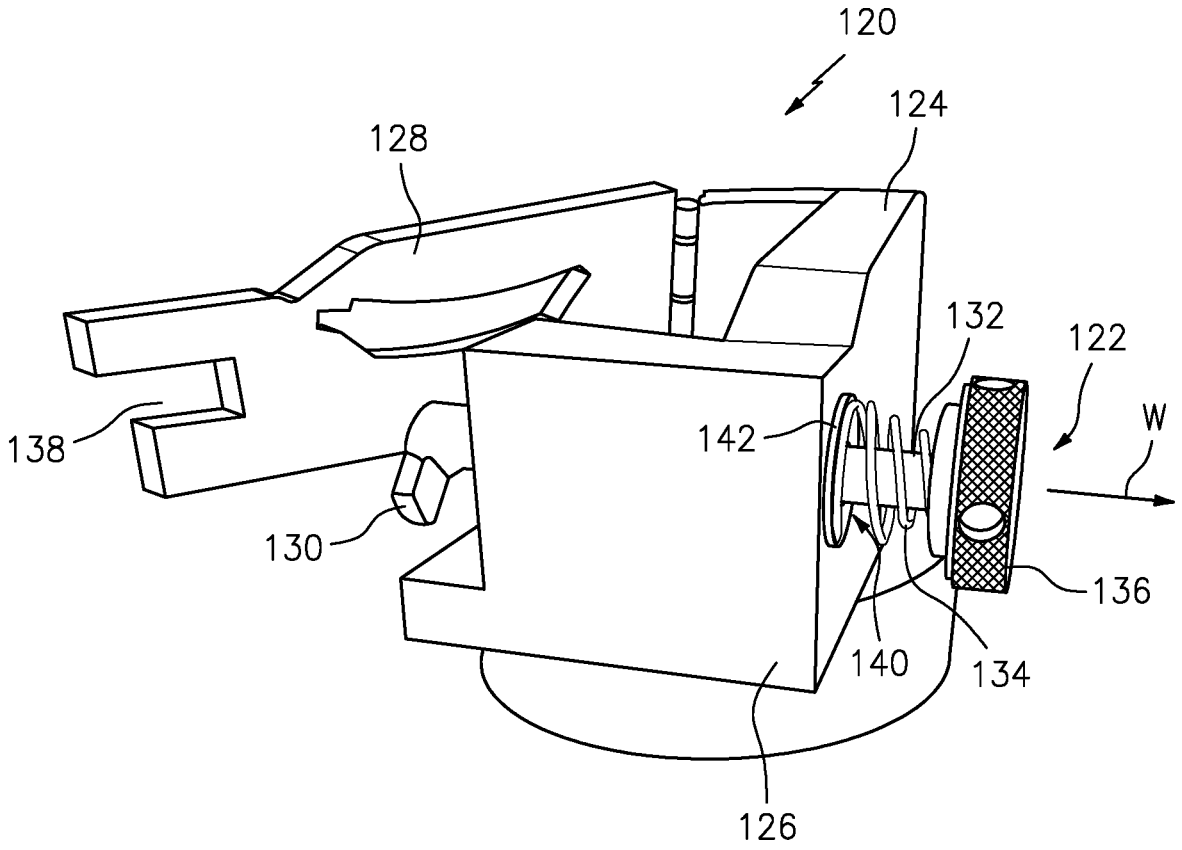
FIG. 3 is a perspective view of a grit boot mask tool in an open position.
Figure 4:
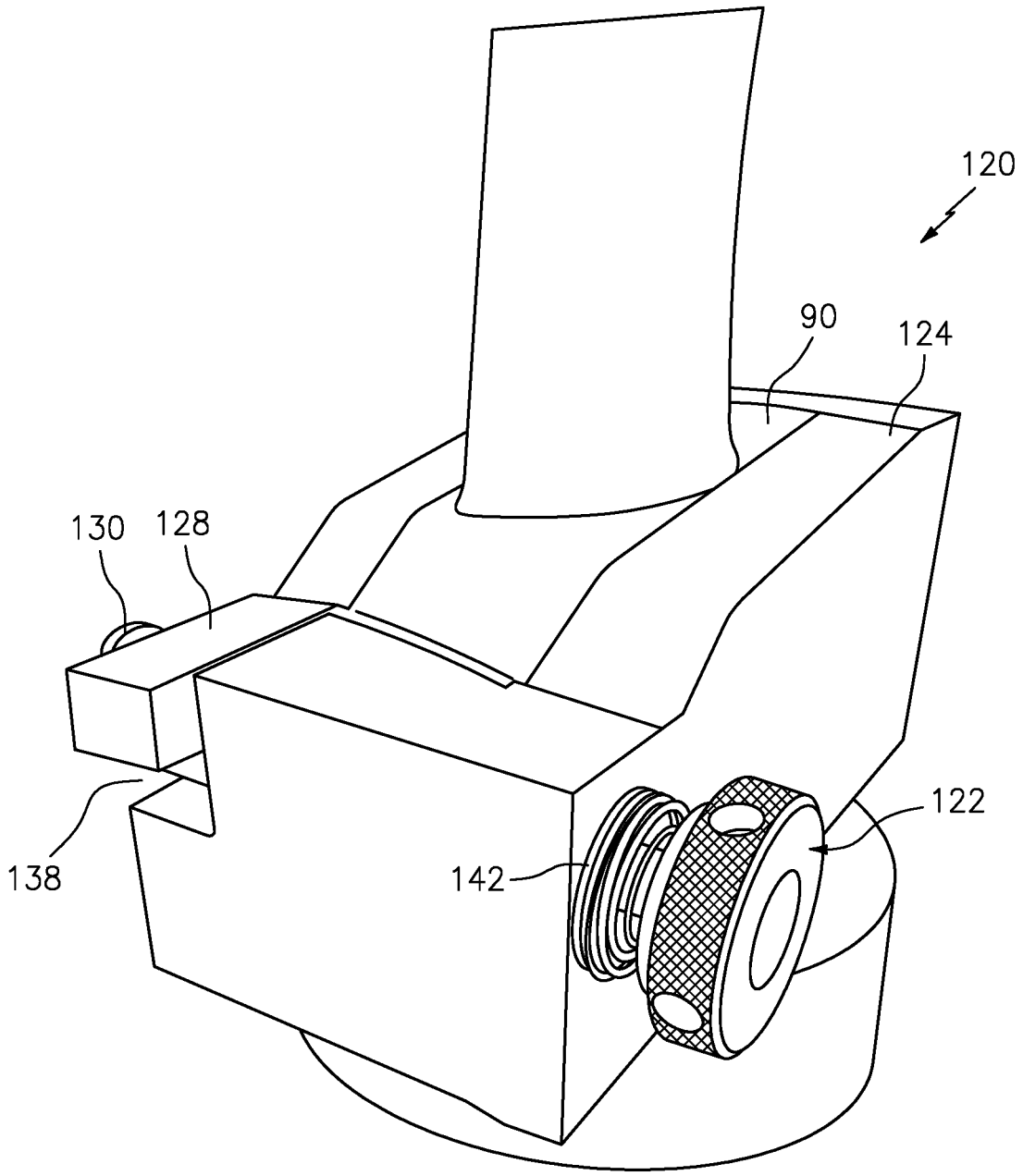
FIG. 4 is a perspective view of the grit boot mask tool in a closed position.

With reference to FIG. 3, a grit boot mask tool 120 includes a lock assembly 122 and a boot 124. The boot 124 may include an enclosure 126 that protects three sides, and a door 128 that completes the enclosure. The enclosure 126 may include various external shapes to facilitate retention within a fixture or other retention device. The door 128 may be hinged to the enclosure 126. The boot 124 in the illustrated embodiment may be manufactured of a rubber material that is internally shaped to receive, retain, and protect the root 88 and an underplatform area (FIG. 4), however, other coating fixtures which protect other areas and other components will benefit herefrom. When fully assembled with the blade properly positioned in the boot 124, only a desired portion of the blade which is to be grit blasted such as the gas path side is exposed. That is, the boot 124 protects that which is not to be grit blasted.

Figure 5:
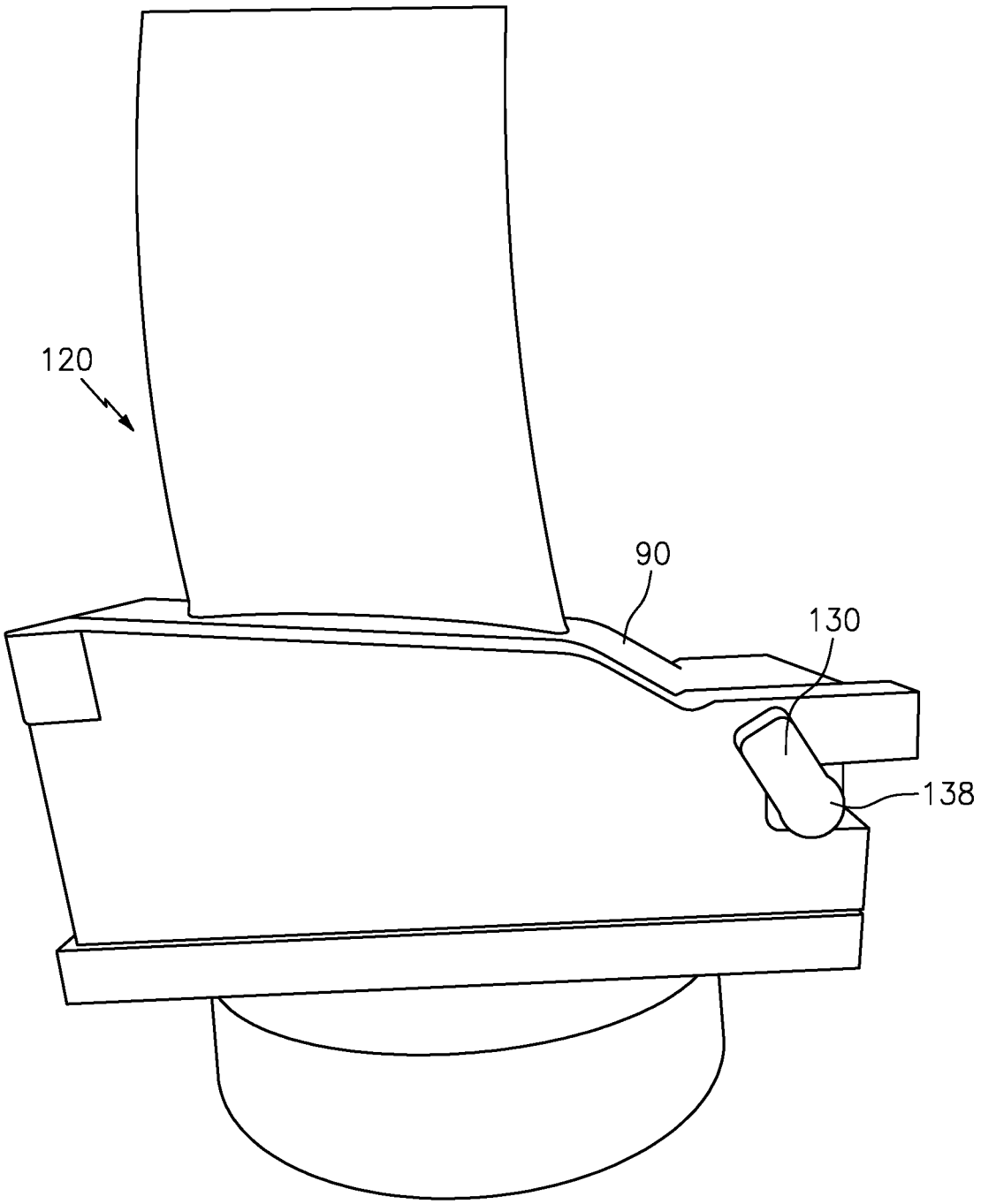
FIG. 5 is a side view of the grit boot mask tool installed on a blade.

The lock assembly 122 generally includes a latch 130, a rod 132, a spring 134, and a knob 136. The latch 130 is transverse to the rod 132 and fits through a slot 138 in the door 128. The rod 132 extends through an aperture 140 in the enclosure 126. The spring 134 is compressed between the knob 136 and a washer 142 adjacent the enclosure so as to bias the rod 132, and thus the latch 130, toward the enclosure 126 (illustrated schematically by arrow W). Rotation of the latch 130 selectively provides a locked position transverse to the slot 138 (FIG. 5) and an unlocked position aligned with the slot 138.

The lock assembly 122 in the illustrated embodiment requires only a quarter turn to lock or unlock the door 128 which provides an ergonomically friendly interface. The lock assembly 122 is also retained to the enclosure to avoid loss or damage.

The use of the terms "a," and "an," and "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason, the appended claims should be studied to determine true scope and content.

What is claimed is:

1. A grit boot mask tool, comprising:

an enclosure to receive at least a portion of a blade;

a door; and a lock assembly that retains the door to the enclosure, wherein the lock assembly comprises a spring biased latch.

2. The grit boot mask tool as recited in claim 1, wherein the enclosure is internally shaped to receive a root of the blade.

3. The grit boot mask tool as recited in claim 1, wherein the enclosure is internally shaped to receive a root of the blade and at least a portion of a platform.

4. The grit boot mask tool as recited in claim 1, wherein the door is hinged with respect to the enclosure.

5. A grit boot mask tool, comprising:

an enclosure to receive at least a portion of a blade;

a door; and a lock assembly that retains the door to the enclosure, wherein the lock assembly comprises a latch that is retained in a locked position by a spring bias.

6. The grit boot mask tool as recited in claim 5, further comprising a knob to push the latch away from the enclosure to overcome the spring bias and rotate the latch.

7. The grit boot mask tool as recited in claim 6, wherein a quarter turn of the knob will lock and unlock the lock assembly.

8. The grit boot mask tool as recited in claim 6, wherein the latch is received through a slot in the door.

9. A method of installing a grit boot mask tool to a blade, comprising:

locating a portion of the blade in an enclosure;

closing a door of the enclosure encasing the portion of the blade; and pressing a knob to overcome the bias then rotating a latch to retain the door to the enclosure.

10. The method as recited in claim 9, wherein locating the portion of the blade in the enclosure comprises fitting a portion of a platform of the blade in the enclosure.

11. The method as recited in claim 9, wherein locating the portion of the blade in the enclosure comprises fitting a root of the blade in the enclosure.

12. The method as recited in claim 9, further comprising overcoming a bias on a lock assembly prior to rotating the latch.

13. A method of installing a grit boot mask tool to a blade, comprising:

locating a portion of the blade in an enclosure;

closing a door of the enclosure encasing the portion of the blade; and rotating a latch to retain the door to the enclosure, wherein rotating the latch comprises rotating a knob of a lock assembly one quarter turn.

14. A method of installing a grit boot mask tool to a blade, comprising:

locating a portion of the blade in an enclosure;

closing a door of the enclosure encasing the portion of the blade; and rotating a latch to retain the door to the enclosure, wherein rotating the latch comprises rotating the latch transverse a slot in the door to lock the door.

15. A method of installing a grit boot mask tool to a blade, comprising:

locating a portion of the blade in an enclosure;

closing a door of the enclosure encasing the portion of the blade; and rotating a latch to retain the door to the enclosure; and rotating the latch to unlock the door by aligning the latch with a slot in the door.

* * * * *